United States Patent [19]

Koll et al.

[11] Patent Number: 4,888,128

[45] Date of Patent: Dec. 19, 1989

[54] PAPER-COATING SLIPS CONTAINING FLUORESCENT BRIGHTENERS

[75] Inventors: Jochen Koll; Friedhelm Müller, both of Odenthal; Werner Bieber, Monheim; Joachim König, Odenthal; Udo Eckstein, Cologne; Hans Theidel, Leverkusen, all of Fed. Rep. of Germany

[73] Assignee: Bayer Aktiengesellschaft, Leverkusen, Fed. Rep. of Germany

[21] Appl. No.: 131,780

[22] Filed: Dec. 11, 1987

[30] Foreign Application Priority Data

Dec. 18, 1986 [DE] Fed. Rep. of Germany ..... 3643215

[51] Int. Cl.[4] ..... C09B 23/14

[52] U.S. Cl. ..... 252/301.23; 252/301.25; 252/301.26; 252/301.29

[58] Field of Search ..... 252/301.23, 301.22, 252/301.25, 301.26, 301.29

[56] References Cited

U.S. PATENT DOCUMENTS

| | | | |
|---|---|---|---|
| 3,954,740 | 5/1976 | Fringeli | 252/301.23 |
| 4,374,643 | 2/1983 | Suzuki et al. | 252/301.23 |
| 4,388,079 | 6/1983 | Suzuki et al. | 252/301.23 |
| 4,466,900 | 8/1984 | Horlacher et al. | 252/301.23 |
| 4,717,502 | 1/1988 | Schmid | 252/301.23 |

*Primary Examiner*—John F. Niebling
*Assistant Examiner*—Steven P. Marquis
*Attorney, Agent, or Firm*—Sprung Horn Kramer & Woods

[57] ABSTRACT

Fluorescent brightener salts of the formula

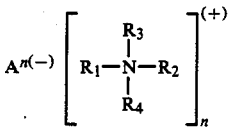

in which

A denotes the anion of an anionic cellulose fluorescent brightener, $R_1$ denotes alkyl, alkenyl, aralkyl, aryl or cycloalkyl, $R_2$, $R_3$ and $R_4$ denote hydrogen or $R_1$, or together, including the N atom, form a heterocyclic ring, and n denotes 1 or 2, are suitable for incorporation into paper-coating slips. The brightened coating slips are distinguished, inter alia, by the fact that the achievable greying limit is very high.

4 Claims, No Drawings

PAPER-COATING SLIPS CONTAINING FLUORESCENT BRIGHTENERS

For the production of coated papers and boards, aqueous coating slips are used to a very great extent, which, besides conventional white pigments—in particular china clay and calcium carbonate—contain polymer dispersions as binders.

For fluorescent brightening of these coating slips, fluorescent brighteners of the alkali metal salts of bistriazonylaminostilbenedisulphonic acids type are generally employed. However, these fluorescent brighteners cause an only unsatisfactory brightening effect and a very low greying limit (fluorescent brightener concentration at which further addition of the brightener causes no increase or even a decrease in whiteness). In addition, the types of fluorescent brightener mentioned have very low light-fastness in these coating slips.

It is generally known that the difficulties mentioned can be partially solved in two ways:

1. by adding to the coating slip small amounts of hydrophilic cobinders to which the fluorescent brighteners are able to attach. Such cobinders are, for example: starch, casein, carboxymethylcellulose, alginates, polyvinyl alcohol, polyacrylates, melamine- or urea-formaldehyde resins (cf. "Das Papier" 36 (1982), 66).

2. The use of specific water-soluble fluorescent brighteners which contain hydrophilic carriers. Such carriers can be, for example, polyglycols (cf. DE-A-3,502,038 and EP-A-43,790).

Both possibilities can only represent a partial solution since addition of the products mentioned to the coating slips are clearly limited: they increase the water sensitivity of the coated papers, which leads to difficulties in certain printing processes and on use of the coated papers. In addition, rheological problems frequently occur on modern high-speed coating machines when these additives are added to the coating slip.

The production of coated papers having a relatively high and a high whiteness is therefore in most cases an object which can be solved with difficulty or frequently unsatisfactorily.

It has therefore already been proposed (cf. DE-A 3,112,435) that water-soluble fluorescent brighteners be attached to certain plastics, such as, for example, urea or methylol resins, and that these brightened plastics be added to the paper-coating slip as a dispersion. However, these proposals have hitherto not been able to establish themselves due to their much too high costs and due to rheological problems.

It has now been found that coating slips for paper coating can be brightened without the disadvantages mentioned when virtually water-insoluble fluorescent brightener salts of the formula

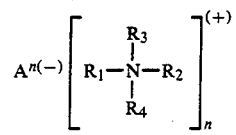

(I)

in which

A denotes the anion of a high-affinity anionic cellulose brightener, $R_1$ denotes optionally substituted alkyl, alkenyl, aralkyl, aryl or cycloalkyl, $R_2$, $R_3$ and $R_4$, independently of one another, denote hydrogen or $R_1$, or in each case 2 or 3 of these radicals may together, including the N atom, form a heterocyclic ring, and n denotes an integer $>0$, of low-molecular weight (i.e. containing no polymeric groups) are employed.

The suitability of these fluorescent brightener salts for the purpose mentioned must be regarded as extremely surprising since it is known that water-soluble fluorescent brighteners based on bistriazonyl-aminostilbene-disulphonic acids, if they are precipitated using conventional polycationic products according to GB 721,238 and 1,058,918, produce only a very unsatisfactory effect, or none at all, in cobinder-free paper-coating slips.

In contrast to this, the fluorescent brightener salts according to the invention when added in finely divided or dissolved form exhibit a varying degree of fluorescence, even if the cationic component is employed in excess.

Suitable heterocyclic compounds which may be formed by 2 of the radicals $R_2$–$R_4$ are saturated 5or 6-membered types, such as morpholine, piperidine or pyrrolidine, inter alia.

Suitable heterocyclic compounds which may be formed by 3 of these radicals are saturated types, in particular pyridine.

Suitable alkyl radicals are, in particular, those which have 1–20° C. atoms and which may be substituted by CN, OH, halogen, $C_1$–$C_4$-alkoxy or $C_1$–$C_4$-alkylcarbonylamino.

Suitable alkylene radicals are, in particular, those having 2 to 10° C. atoms.

Suitable aralkyl radicals are phenyl-$C_1$–$C_3$-alkyl radicals.

Suitable aryl radicals are phenyl radicals, which may be substituted by halogen, $C_1$–$C_4$-alkyl or $C_1$–$C_4$alkoxy.

Suitable cycloalkyl radicals are, above all, cyclohexyl radicals.

"Halogen" is preferably taken to mean Cl and Br.

Suitable cellulose fluorescent brighteners from which the radical A is derived are bistriazolylstilbene-, bisstilbene- and, above all, bistriazinyl-aminostilbenedisulphonic acids.

Preferred fluorescent brightener salts of the formula I are those in which $R_1$–$R_4$ do not represent H. Particularly preferred salts contain a hydrophobizing radical, such as, for example, $C_6$–$C_{20}$-alkyl, aralkyl or aryl.

Examples of suitable radicals A are those of the formula

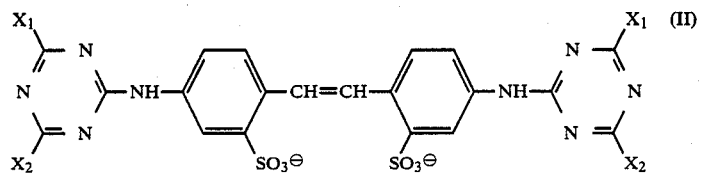

(II)

in which $X_1$ denotes amino, methylamino, ethylamino, dimethylamino, diethylamino, 2-hydroxy-ethylamino, 3-hydroxypropylamino, di-(2-hydroxy-ethyl)amino, di-(2-hydroxy-propyl)-amino, 2-sulphoethylamino, morpholino, anilino, chloroanilino, sulphoanilino, methylanilino or disulphoanilino, and $X_2$ denotes hydroxyl, methoxy, ethoxy, methoxyethoxy, chlorine or $X_1$, and also those of the formula

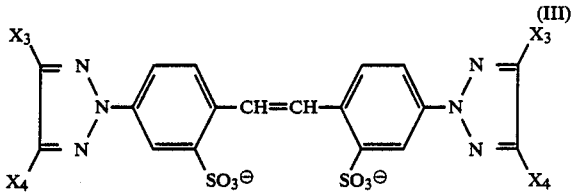

(III)

in which $X_3$ and $X_4$ denote hydrogen, methyl, ethyl, phenyl or sulphophenyl, and of the formula

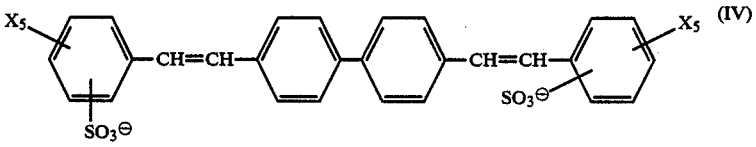

(IV)

in which $X_5$ denotes hydrogen, methyl, ethyl, methoxy, ethoxy, chlorine or sulpho.

In the preparation of the compounds of the formula I, a procedure is expediently followed in which fluorescent brighteners according to the formulae II - IV, as sulphonic acids or water-soluble salts thereof, in particular alkali metal salts thereof, are reacted with low-molecular-weight, basic nitrogen compounds of the formula V

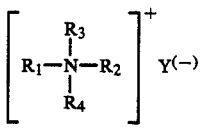

(V)

in which

Y denotes a colourless, non-fluorescing anion or $OH^{(-)}$, it being possible in some cases to also use a 10–20% deficiency or an up to 50% excess of V.

The reaction is carried out in water and/or organic solvents, such as methanol, ethanol, propanol, isopropanol, butanol, glycol, glycol methyl ether, dimethylformamide, dimethylacetamide, dimethyl sulphoxide, sulpholane or hexamethylphosphoric triamide, at temperatures from 20° C. to the reflux temperature of the respective solvent.

The sparingly soluble fluorescent brightener salts thus obtained can be employed as fluorescent brighteners either directly or after prior fine-grinding or liquefying.

The dispersions according to the invention can be prepared as follows:

the press cakes and/or powders are homogenized with vigorous stirring after addition of a surfactant and, if appropriate, water. The amounts of the surfactant can then be increased, if appropriate to the full amount required for stability of the dispersion.

The suspension obtained is then precomminuted and wet-ground.

The precomminution can take place by means of pebble or toothed colloid mills.

The subsequent wet-comminution can then take place in colloid, swing, ball and vibration mills and also in dissolvers or sub-micron dispersers. However, continuous agitator mills with grinding elements, preferably made from $SiO_2$ of diameters 0.2 to 5 mm, are preferably used.

After grinding, further amounts of surfactant or hydrotropic substances, such as, for example, ethylene glycol or glycerol, preservatives, wetting agents, defoamers and/or water can be added, if appropriate, unless this has already taken place at an earlier point in time, for example before grinding.

A further way of preparing the sparingly watersoluble or water-insoluble fluorescent brighteners according to the invention and their dispersions is to combine the reaction and grinding processes:

to this purpose, the alkali metal salts of the fluorescent brighteners according to formulae II–IV are wet-comminuted together with the basic nitrogen compounds of the formula V and also water and surfactants after homogenization and precomminution, it being possible to vary the amounts used, as specified above.

In this case, the complete reaction of the fluorescent brightener salts II–IV with the basic nitrogen compounds V takes place in the mill, preferably in a continuous agitator mill with $SiO_2$ grinding elements.

The dispersions according to the invention prepared by the two processes contain 1 to 25%, preferably 5 to 20%, of the sparingly water-soluble or water-insoluble fluorescent brightener salts according to the invention, 1 to 50%, preferably 5 to 20%, of surfactants, 0 to 15% of preservatives and water, it being possible to replace part of the water with hydrotropic substances (% = per cent by weight).

Possible surfactants are all conventional cationic and nonionogenic surfactants, as described, for example, in German Offenlegungsschrift 2,334,769, pages 8 to 10 (corresponds to British Patent Specification 1,417,071).

Nonionogenic surfactants are preferably employed.

The paper-coating slips into which the fluorescent brightener salts to be used according to the invention are incorporated are composed as follows: polymer dispersions based on styrene-butadiene, carboxylated styrene-butadiene or polyvinyl acetate copolymers or based on acrylates, combined with white pigments, either without or with small amounts of hydrophilic cobinders.

The amount of compounds I used depends on the brightening effect desired. In general, 0.01 to 0.5% by weight of pure active substance (relative to the solid of the paper-coating slips to be brightened) is sufficient. A particular advantage is that, depending on the coating slip composition, the greying limit achievable (up to which further addition of fluorescent brightener causes additional effects) is extremely high.

EXAMPLE 1

10 g of the fluorescent brightener of the formula

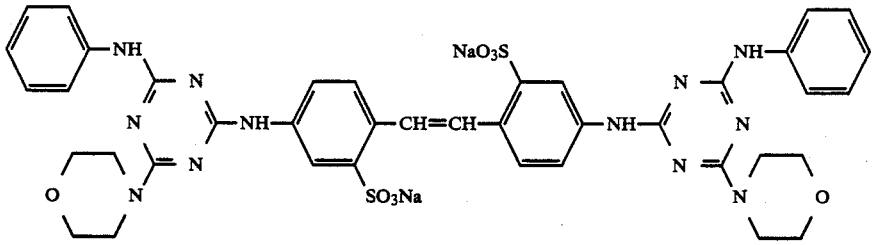

and 10 g of benzyl-n-dodecyldimethylammonium chloride are refluxed for 30 minutes in 100 ml of water. The product is then filtered off at about 60° C. and washed with water at 60° C. After drying in vacuo, 14.5 g of the quaternary ammonium salt of the fluorescent brightener of the above formula of melting point: 258–259° C., which can be recrystallized from n-butanol, are obtained. The substance is insoluble in water and can be converted into an aqueous dispersion in accordance with Examples 9–13.

The dispersion according to Examples 14–16, incorporated into a paper-coating slip, gives excellent white effects.

EXAMPLE 2

In the same fashion as described in Example 1, the fluorescent brightener of the formula (1) is reacted with 7.5 g of benzyldimethyl-phenylammonium chloride. 12.2 g of pale yellow crystals of melting point: 259–260° C., which can be recrystallized from ethylene glycol, are obtained.

The substance is virtually insoluble in water and, as a dispersion, exhibits excellent white effects in paper-coating slips.

EXAMPLE 3

0.6 g of the fluorescent brightener of the formula

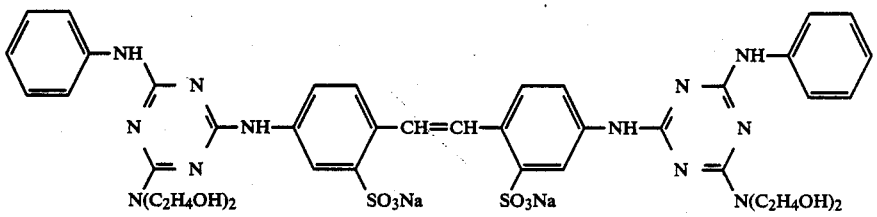

(2)

is refluxed for 1 hour with 6 g of benzyl-dimethyl-phenylammonium chloride in 200 ml of water. Filtering off at about 50–60° C. and drying in vacuo yield 8 g of a pale yellow crystalline powder of melting point: 212–215° C., which can be recrystallized from n-butanol. As a dispersion, gives brilliant white effects in papercoating slips.

EXAMPLE 4

6 g of the fluorescent brightener of the formula

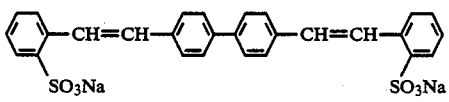

(3)

are refluxed for 1 hour with 10 g of benzyldodecyldimethylammonium chloride in 100 ml of water. Filtering off and drying in vacuo yield 10.3 g of virtually colourless crystals of melting point: 268–270° C., which can be recrystallized from ethylene glycol.

EXAMPLE 5

7 g of the fluorescent brightener of the formula

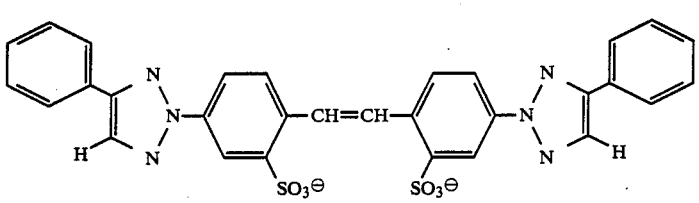

(4)

are refluxed for 2 hours with 10 g of benzyl-dodecyl-dimethylammonium chloride in 120 ml of dimethylformamide, and the product is filtered off after cooling to 10° C. 8.7 g of pale yellow crystals of melting point: 182–184° C., which can be recrystallized from ethylene glycol, are obtained.

EXAMPLE 6

8.5 g of the fluorescent brightener of the formula

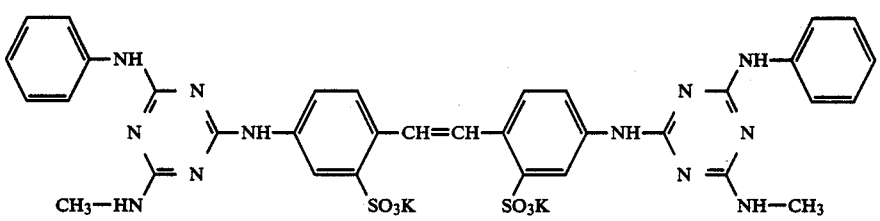

(5)

are dissolved in 100 ml of water and then refluxed for 2 hours with 10 g of benzyldimethylphenyl-ammonium chloride. Cooling and filtering off under suction yield 13 g of yellowish crystals of melting point: 224–226° C., which can be recrystallized from ethylene glycol.

EXAMPLE 7

10 g of the fluorescent brightener of the formula (1) and 3 g of triethylamine hydrochloride in 150 ml of water are refluxed for 1 hour and cooled, and yellowish crystals, which can be recrystallized from methyl glycol, are filtered off.

EXAMPLE 8

In the same fashion as described in the previous examples, further sparingly soluble quaternary ammonium salts of fluorescent brighteners can be obtained by reacting compounds of the formula

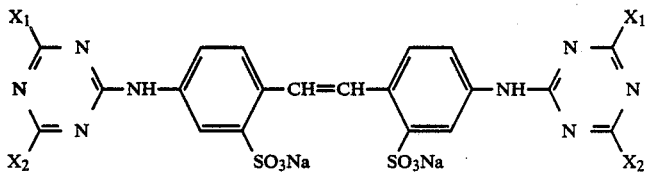

(6)

with ammonium salts of the formula

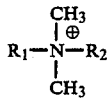

(7)

The following table contains the radicals of the starting compounds (6) and (7) used.

| Example | $X_1$ | $X_2$ | $R_1$ | $R_2$ |
|---|---|---|---|---|
| a | $OCH_3$ | $N(C_2H_4OH)_2$ | $CH_3$ | $CH_3$ |
| b | $OCH_3$ | $NH(CH_2CH_2SO_3Na)$ | $CH_3$ | $CH_3$ |
| c | $NH—C_6H_5$ | $NH(C_2H_4OH)$ | $CH_3$ | $C_6H_5$ |
| d | $NH—C_6H_5$ | $NH(C_2H_4OH)$ | $CH_3$ | $CH_2—C_6H_5$ |
| e | $NH—C_6H_5$ | $NH—CH_3$ | $CH_2—C_6H_5$ | $C_{12}H_{25}$ |
| f | $NH—C_6H_5$ | $NH—C_2H_5$ | $C_6H_5$ | $CH_2—C_6H_5$ |
| g | 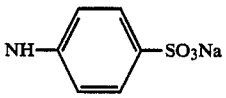 | $N(C_2H_4OH)_2$ | $CH_6H_5$ | $CH_2—C_6H_5$ |
| h | $NH_2$ | $NH_2$ | $CH_2—C_6H_5$ | $C_{14}H_{29}$ |
| i | $OCH_3$ | $NCH_3(C_2H_4OH)$ | $CH_3$ | $C_{12}H_{25}$ |
| k | $NH_2$ | $NH—C_5H_5$ | $CH_2—C_6H_5$ | $CH_2C_6H_5$ |
| l | $NH—C_6H_5$ | $NH—C_2H_5$ | $C_6H_5$ | $C_{12}H_{25}$ |
| m | $NH—C_6H_5$ | $NH(C_2H_4OH)$ | $H_4—C_6H_5$ | $C_2H_4—C_6H_5$ |
| n | $NH—C_6H_5$ | $NCH_3(C_2H_4OH)$ | $CH_3$ | $C_2H_4—C_6H_5$ |

EXAMPLE 9

200 g of the water-insoluble fluorescent brightener salt prepared according to Example 1 are homogenized together with 200 g of emulsifier and 600 g of water and precomminuted using a toothed colloid mill. The suspension is then wet-comminuted at room temperature by means of 4 passes through a bead mill. The resultant stable dispersion can easily be incorporated into paper-coating slips and exhibits excellent white effects, even when large amounts are added (cf. Examples 14–16).

EXAMPLE 10

160 g of the fluorescent brightener of the formula 1 from Example 1 are homogenized with stirring with 128 g of benzyldimethyl-phenyl-ammonium chloride, 160 g of emulsifier and 552 g of water, and precomminuted using a toothed colloid mill. The suspension is wet-comminuted at room temperature by means of 4 passes through a bead mill. The resultant stable dispersion can easily be incorporated into paper-coating slips and exhibits excellent white effects.

EXAMPLE 11

160 g of the fluorescent brightener of the formula 1 from Example 1 are homogenized with stirring with 128 g of benzyl-dodecyl-dimethyl-ammonium chloride (=110% of the stoichiometric amount), 16 g of emulsifier and 520 g of water, and precomminuted using a toothed colloid mill. The suspension is wet-comminuted at room temperature by means of 4 passes through a bead mill, and, after incorporation into paper-coating slips, exhibits excellent white effects.

EXAMPLE 12

In the same fashion as described in Example 9, the sparingly water-soluble or water-insoluble fluorescent brightener salts of Examples 4, 5 and 6 and the compounds (a)–(n) described in Example 8 can be converted into stable dispersions.

EXAMPLE 13

In the same fashion as described in Examples 10 and 11, the starting materials (a)–(n) described in Example 8 can also be reacted and converted into stable dispersions.

EXAMPLE 14

By stirring together
31 parts by weight of china clay SPS,
13 parts by weight of calcium carbonate,
26 parts by weight of a 50% strength dispersion of a butadiene-styrene copolymer, and
30 parts by weight of water,
a paper-coating slip is prepared, the pH of which is adjusted to 8.5 using sodium hydroxide solution.

5 or 10 or 30 or 50 g of the fluorescent brightener dispersions prepared according to Examples 9–13 are added to 1 kg of this coating slip and stirred in.

After coating the brightened coating slips onto paper with the aid of a hand coater or a pilot coating machine and after drying at 20–130° C., coated papers are obtained which, depending on the amount of fluorescent brightener added, exhibit a clear to excellent brightening effect. Even when more than 50 g of fluorescent brightener is added per kg of coating slip, an increase in whiteness can usually still be achieved.

As comparison, fluorescent brighteners can be used, for example, which are usually employed in papercoating slips:

Fluorescent brightener A: No. 14 from the table of Example 8, without reaction with a quaternary ammonium salt, approximately 25% strength aqueous solution.

Fluorescent brightener B: in formula (6) from Example 8:

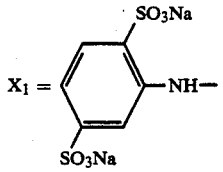

$X_2 = (HO\text{-}C_2H_4)_2N$- without reaction with a quaternary ammonium salt, approximately 25% strength aqueous solution which additionally contains approximately 40% of a polyglycol as carrier.

On addition of 5 g of the fluorescent brightener A or B per kg of coating slip in place of the fluorescent brightener dispersions described in Examples 9–13, approximately the same white effects are achieved.

On addition of 10 g/kg, the fluorescent brightener dispersions described already produce a better white effect than fluorescent brightener A and the majority are somewhat better than fluorescent whitener B.

On addition of more than 30 g/kg, significantly better white effects are achieved using the fluorescent brightener dispersions described than using the water-soluble fluorescent brighteners A and B.

EXAMPLE 15

In the same fashion as described in Example 14, coating slips and paper coatings can be prepared using a polymer dispersion based on an acrylate polymer.

The fluorescent brightener dispersions prepared according to Examples 9–13 have a clearly better white effect than conventional water-soluble fluorescent brighteners (for example fluorescent brighteners A and B from Example 14), above all when relatively large amounts are added.

EXAMPLE 16

In the same fashion as described in Example 14, paper coatings can be prepared using the following coating slips:
32 parts by weight of china clay SPS,
14 parts by weight of calcium carbonate,
9.0 parts by weight of a 50% strength dispersion of a butadiene-styrene copolymer,
4.5 parts by weight of starch, and
40.5 parts by weight of water pH 8.5.

In this type of coatings, although the conventional water-soluble fluorescent brighteners (for example A and B in Example 14) produce good white effects, the results using the fluorescent brightener dispersions described according to Examples 9–13 are markedly better when relatively large amounts are added.

We claim:

1. Aqueous paper-containing slips based on polymer dispersions, containing virtually water-insoluble fluorescent brightener salts of the formula

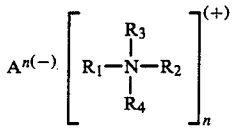

(I)

in which

A denotes the anion of a high-affinity, anionic cellulose fluorescent brightener, $R_1$, $R_2$, $R_3$ and $R_4$ each independently denote optionally substituted alkyl, alkenyl, phenyll-$C_1$-$C_3$-alkyl, phenyl or cycloalkyl, or any 2 or 3 of these radicals may together, including the N atom, form a morpholine, piperidine, pyrrolidine or pyridine ring, and n denotes an integer >0 with the proviso that at least one of the radicals $R_1$, $R_2$, $R_3$ or $R_4$ is a hydrophobizing radical selected from the group consisting of $C_{10}$–$C_{20}$-alkyl, optionally substituted phenyl-$C_1$-$C_3$-alkyl or phenyl.

2. Coating slips according to claim 1, wherein the fluorescent brightener salts which they contain are those of the specified formula, in which A represents a radical of the formula

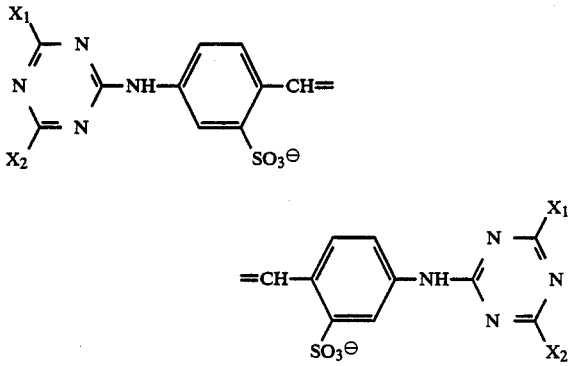

in which $X_1$ denotes amino, methylamino, ethylamino, dimethylamino, diethylamino, 2-hydroxy-ethylamino, 3-hydroxy-propylamino, di-(2-hydroxyethyl)-amino, di-(2-hydroxy-propyl)-amino, 2-sulphoethylamino, morpholino, anilino, chloroanilino, sulphoanilino, methylanilino or 2-disulphoanilino, and $X_2$ denotes hydroxyl, methoxy, ethoxy, methoxyethoxy, chlorine or $X_1$.

3. Coating slips according to claim 1, containing a compound of the formula

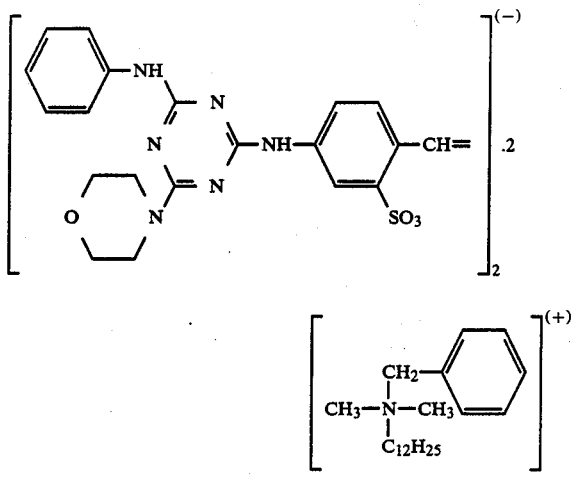

4. Coating slips according to claim 1, containing a compound of the formula

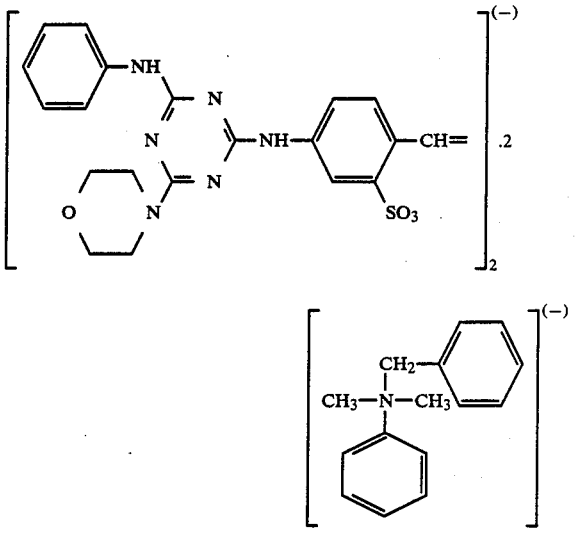

* * * * *